United States Patent [19]

Finn

[11] 3,942,417

[45] Mar. 9, 1976

[54] DISPENSER CARTON AND METHOD OF MANUFACTURE

[76] Inventor: William W. Finn, 303 N. Kalamazoo Ave., Marshall, Mich. 49068

[22] Filed: Feb. 12, 1974

[21] Appl. No.: 441,880

Related U.S. Application Data

[63] Continuation-in-part of Ser. No. 320,110, Jan. 2, 1973, abandoned.

[52] U.S. Cl. ..... 93/49 M; 93/36 M

[51] Int. Cl.[2] ..... B31B 1/26

[58] Field of Search ..... 225/48–52, 225/91; 93/36 CE, 36 M, 49 M

[56] References Cited

UNITED STATES PATENTS

| | | | |
|---|---|---|---|
| 2,628,179 | 2/1953 | Bergstein | 93/36 CE |
| 2,888,181 | 5/1959 | Lincoln et al. | 225/49 UX |
| 3,193,427 | 7/1965 | Rogers | 225/49 UX |

FOREIGN PATENTS OR APPLICATIONS

| | | | |
|---|---|---|---|
| 240,324 | 9/1962 | Australia | 225/50 |

*Primary Examiner*—Donald R. Schran
*Assistant Examiner*—Leon Gilden
*Attorney, Agent, or Firm*—Learman & McCulloch

[57] ABSTRACT

A dispenser carton for use in dispensing sheet material from a roll contained within the carton comprises bottom, rear, front, and end panels joined to one another to form a hollow carton body open at its top. One edge of a top panel is hingedly joined to the upper edge of the rear panel so as to overlie the top of the carton and its opposite edge is joined to a flap which partially overlies the front panel. At the juncture between the front and bottom panels is a gap defining two spaced apart edges both of which carry an abrasive adhesive which forms tearing means for sheet material dispensed from the carton.

4 Claims, 5 Drawing Figures

DISPENSER CARTON AND METHOD OF MANUFACTURE

RELATED APPLICATION

This application is a continuation-in-part of application Ser. No. 320,110, filed Jan. 2, 1973, now abandoned.

The invention disclosed herein relates to the manufacture of a carton adapted to contain sheet material wound on a roll and from which any desired length of material may be unwound and severed or torn from the remainder of the material. The tearing of the sheet material is facilitated by a tear strip forming an integral part of the carton.

Cartons of the kind to which the invention relates are in wide usage, particularly for the dispensing of materials such as foil, waxed paper, various kinds of synthetic wrapping materials, and the like. All such cartons incorporate tearing means of one kind or another for the purpose of enabling a length of material withdrawn from the carton to be severed from the roll of material. The provision of an adequate tearing device has been particularly troublesome. Because cartons of the kind described conventionally are used in kitchens where water abounds, the tearing device must be resistant to deterioration due to water contact. Moreover, the carton itself must be capable of withstanding contact with water without undue weakening or other deterioration of the structural integrity of the carton.

From a structural point of view, the most reliable tearing device heretofore in use with dispensing cartons is a metal strip having a toothed or serrated edge against which the sheet material may bear so as to tear the material. A metal strip, however, has many disadvantages. For example, it must be manufactured separately from the carton itself and then staked, adhered, or otherwise affixed to the carton. These operations require machinery and manpower, thereby increasing the cost of manufacture and assembly of such cartons. In addition, metal tearing devices can mar counters, tables, appliances, and the like on which the cartons are used. Moreover, metal tearing devices having serrated or toothed edges can cause injury to the person using a carton equipped with such a tearing device.

Another disadvantage of metal tearing devices is that they are likely to rust unless they are formed of rust inhibiting metal or are treated with a rust inhibiting coating. Such metals and coatings add to the expense of the cartons.

A further disadvantage of metal tearing devices is that they prevent or interfere with recycling of the carton bodies unless the metal strips first are removed from the bodies. In either case, the metal strips must be handled in a manner differently from that in which the cartons themselves are handled or treated in recycling operations.

The disadvantages of metal tearing devices as described above are well known, and many proposals have been made for effecting substitution of some other kind of tearing device for the metal strips. Most, if not all, of these proposals have required modification of the carton itself, with the consequent modification or redesign of the carton manufacturing and erecting machinery presently in use. Such machinery represents a substantial capital investment on the part of carton manufacturers who understandably have been reluctant to incur the expense of such modifications or redesign, particularly in view of the highly competitive nature of the carton manufacturing industry.

An object of this invention is to provide a dispensing carton having a self-contained tearing device and which overcomes or greatly minimizes the disadvantages referred to above.

Another object of the invention is to provide a tearing device for a dispensing carton and which reinforces the carton and can be applied to the carton during the manufacture of the latter.

A further object of the invention is to provide a carton having an integral tearing device and which may be manufactured and erected by machinery presently in use.

Another object of the invention is to provide a dispensing carton and tearing device combination which is less expensive to manufacture than cartons currently manufactured for similar purposes and which is recyclable.

A further object of the invention is to provide a method of manufacturing a carton of the character described.

Other objects and advantages of the invention will be pointed out specifically or will become apparent from the following description when it is considered in conjunction with the appended claims and the accompanying drawings, in which:

Figure 1:
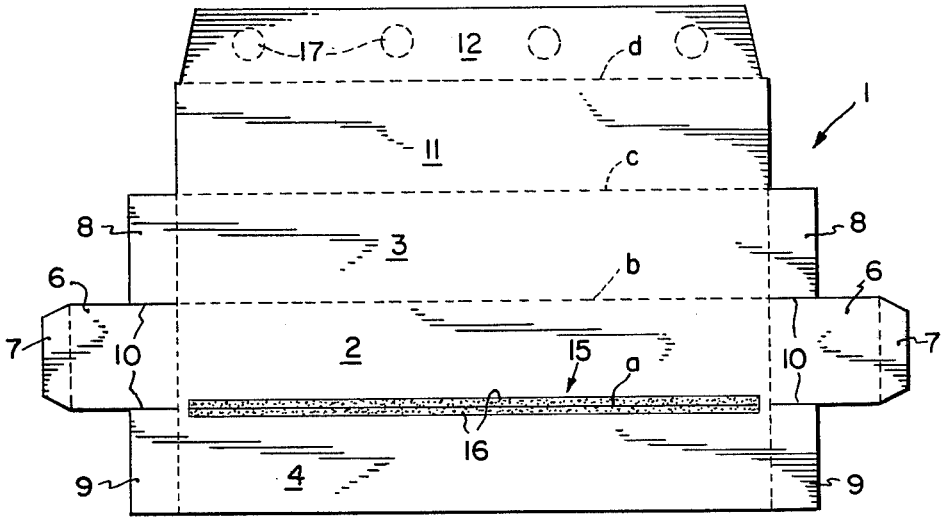
FIG. 1 is a plan view of a blank from which a carton according to the invention may be manufactured.
Figure 2:
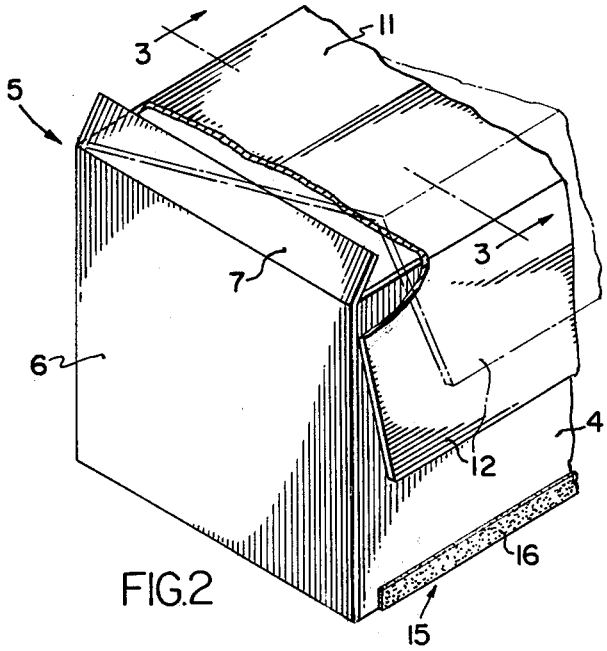
FIG. 2 is a fragmentary, isometric view on an enlarged scale of a carton formed from the blank shown in FIG. 1.
Figure 3:
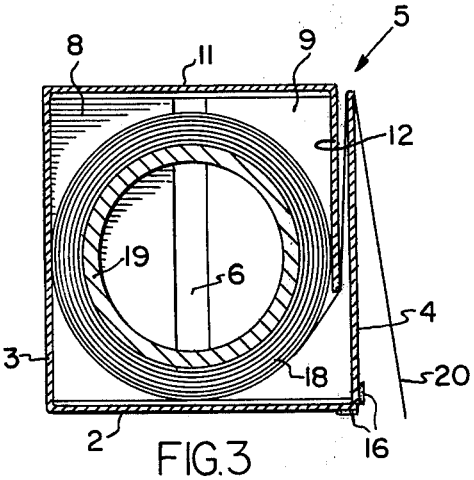
FIG. 3 is a sectional view taken on the line 3—3 of FIG. 2, but illustrating the carton in condition for the dispensing of sheet material wound on a roll.
Figure 4:
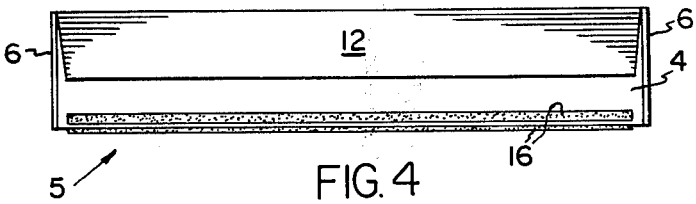
FIG. 4 is a front elevational view, on a reduced scale, illustrating the carton shown in FIG. 2.

A carton constructed in accordance with the invention is manufactured from a blank 1 of a suitable material such as 16 or 18 point solid kraft paperboard which is die cut and which is scored along the lines *a*, *b*, and *c* shown in FIG. 1 to provide a plurality of panels 2, 3, and 4 which may be bent or folded to form an open top carton 5 in which the panel 2 forms the bottom wall, the panel 3 forms the rear wall, and the panel 4 forms the front wall. The panel 2 has extensions 6 which form end walls for the carton 5 and each extension terminates in a tab 7 which may be bent to project inwardly of the carton as is best shown in FIG. 2. The panels 3 and 4 have tabs 8 and 9, respectively, severed from the extensions 6 by slits 10, so as to enable them to be folded inwardly of the carton and glued to the inner surfaces of the adjacent extensions 6 to reinforce the end walls of the carton.

Joined to the panel 3 is one edge of a similar panel 11 which forms the top wall of the carton. Joined to the opposite edge of the panel 11 is one edge of a panel or flap 12 which is adapted to overlie the front wall 4 of the carton in the manner shown in FIG. 2. Between the panels 11 and 12 is a score line *d*.

The length and width of the panels 2, 3, 4, and 11 are substantially uniform so that the carton formed thereby is substantially square in cross-section. The length of the flap 12 corresponds substantially to the length of the other panels and its opposite ends taper toward its free edge. The width of the flap 12 is substantially ½ the width of the panel 4.

The score line *a* between the panels 2 and 4 is a cut score. That is, the skin of the stock from which the blank 1 is made is cut, but the depth of the cut is less than the thickness of the stock. When the blank 1 is in its flat condition, as shown in FIG. 1, the opposing edges 13 and 14 of the cut score abut one another.

An abrasive adhesive 15 is applied to the adjacent edges of the panels 2 and 4 in such manner that it forms a strip 16 which overlies the cut score *a*. The adhesive is applied by any conventional striping process or any other conventional process. The abrasive adhesive preferably comprises a waterproof, volatile, quickly drying printing ink or commercially available adhesive in which is suspended a large quantity of silicate or other grit. The printing ink or adhesive preferably is one which is capable of impregnating the edges of the cut score *a* so as to swell and reinforce the edges. The printing ink or adhesive, upon drying, bonds the grit to the cutting teeth to provide a myriad of sharp, abrasive particles extending the length of the strip 16.

The flap 12 has its inner surface provided with a plurality of beads of separable adhesive 17 adjacent the free edge of the flap so as to enable the free edge of the flap to be bonded lightly to the front wall 4 of the carton and in overlapping relation therewith.

To erect the carton, the panels 2, 3, 4, 11, and 12 are bent about the score lines *a – d*, and the flaps 6 folded to form end walls. Prior to folding and securing of the end flaps 6, a roll of sheet material 18 wound on a core 19 is placed within the carton. Afterward, the flaps 6 and the tabs 8 are secured to form the finished carton.

Figure 5:
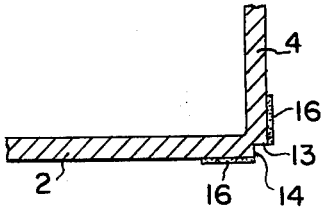
FIG. 5 is a greatly enlarged view of a portion of FIG. 3.

When the panels 2 and 4 are bent about the cut score line *a*, the edges 13 and 14 of the cut score *a* are spread apart by about 90° as is shown in FIG. 5. These edges are sharp and are reinforced by the adhesive. In addition, each edge has a myriad of sharp, abrasive particles extending substantially the length thereof, thereby providing a tear strip for the sheet material 18. The sharpness of the of the edges 13 and 14 is related to the thickness of the adhesive and to the extent of impregnation of the edges by the adhesive. Accordingly, the thickness of the adhesive strip should be only that necessary to assure firm retention of the grit particles. The thickness of the adhesive thus will depend in part on the size of the particles and may be determined empirically.

To dispense sheet material from the carton, the flap 12 is separated from the front wall 4 and is swung upwardly, together with the top panel 11, about the juncture of the top panel with the rear wall 3, as is indicated in chain lines in FIG. 2, so as to enable the leading end 20 of the sheet material 18 to be withdrawn from the interior of the carton. Thereafter, the flap 12 may be fitted into the carton with the leading end of the sheet material interposed between the flap and the inner surface of the front wall 4.

To sever a length of the sheet material, the leading end 20 is withdrawn from the carton and is caused to bear against the abrasively coated cutting edges 13 and 14. The sharpness of the cutting edges, coupled with the abrasiveness of the gritty particles, facilitates the tearing of the sheet so as to enable a desired length of material to be severed from the roll.

The impregnation of the adjacent edges of the carton walls 2 and 4 reinforces the latter at the zone of greatest stress, such stress being generated by the tearing of the sheet. The reinforcement of the adjacent portions of the walls 2 and 4 of the carton, coupled with the water-proof character of the abrasive adhesive 15, enhances the ability of the carton to withstand deterioration due to contact with moisture.

The disclosed embodiment is representative of a presently preferred form of the invention, but is intended to be illustrative rather than definitive thereof. The invention is defined in the claims.

I claim:

1. A method of forming a dispensing carton adapted for the dispensing of a selected length of material from a roll thereof, said method comprising forming a blank of material; scoring said blank to form a plurality of panels; slitting said blank between two adjacent panels to a depth less than the thickness of said material; applying a strip of abrasive material to each of said two panels and overlying the slit therebetween; folding said two panels about said slit to a position in which they are substantially normal to one another; and folding the remainder of said panels to form with said two panels a container for said roll, the folding of said two panels about said slit effecting separation of the edges of said two panels on opposite sides of said slit.

2. The method according to claim 1 wherein the slit between said two panels extends substantially the full length thereof.

3. The method according to claim 2 wherein the slit is uninterrupted from end to end.

4. The method according to claim 1 wherein said strip of abrasive material is applied by impregnating said two panels adjacent the slit with an adhesive substance and embedding gritty particles in said substance.

* * * * *